US009978332B2

(12) United States Patent
Lee et al.

(10) Patent No.: US 9,978,332 B2
(45) Date of Patent: May 22, 2018

(54) DISPLAY DEVICE AND DRIVING METHOD THEREOF IN WHICH BIAS CURRENT OF DATA DRIVER IS CONTROLLED BASED ON IMAGE PATTERN INFORMATION

(71) Applicant: Samsung Display Co., Ltd., Yongin (KR)

(72) Inventors: Yong Soon Lee, Asan-si (KR); Moon Shik Kang, Yongin-si (KR); Jin Ho Park, Suwon-si (KR)

(73) Assignee: Samsung Display Co., Ltd, Yongin-si (KR)

( * ) Notice: Subject to any disclaimer, the term of this patent is extended or adjusted under 35 U.S.C. 154(b) by 247 days.

(21) Appl. No.: 14/448,558

(22) Filed: Jul. 31, 2014

(65) Prior Publication Data

US 2015/0228241 A1 Aug. 13, 2015

(30) Foreign Application Priority Data

Feb. 11, 2014 (KR) ..... 10-2014-0015557

(51) Int. Cl.
*G09G 3/36* (2006.01)

(52) U.S. Cl.
CPC ..... *G09G 3/3688* (2013.01); *G09G 3/3648* (2013.01); *G09G 2310/0248* (2013.01); *G09G 2330/021* (2013.01)

(58) Field of Classification Search
CPC ..... G09G 3/3607; G09G 3/3696; G09G 2310/0237; G09G 2310/027; G09G 2310/0278; G09G 3/3648; G09G 3/20; G09G 3/3688; G09G 3/36; G09G 2330/021; G09G 2310/0248
USPC ..... 341/122, 145; 345/89, 211, 213
See application file for complete search history.

(56) References Cited

U.S. PATENT DOCUMENTS

| | | | | |
|---|---|---|---|---|
| 5,926,173 | A | 7/1999 | Moon | |
| 6,225,992 | B1 * | 5/2001 | Hsu | G09G 3/3696 327/544 |
| 7,212,185 | B2 | 5/2007 | Yanagi et al. | |
| 7,995,044 | B2 | 8/2011 | Moon et al. | |
| 8,310,433 | B2 | 11/2012 | Tanada et al. | |
| 2005/0093488 | A1 * | 5/2005 | Hung | H05B 33/0842 315/307 |
| 2006/0049768 | A1 * | 3/2006 | Yang | H04N 17/04 315/150 |
| 2006/0061532 | A1 * | 3/2006 | Hashimoto | G09G 3/3611 345/89 |

(Continued)

FOREIGN PATENT DOCUMENTS

| | | |
|---|---|---|
| JP | 3356580 | 10/2002 |
| JP | 2006-133673 | 5/2006 |

(Continued)

*Primary Examiner* — James Nokham
(74) *Attorney, Agent, or Firm* — H.C. Park & Associates, PLC

(57) ABSTRACT

A display device including: a display panel including pixels and data lines; a data driver configured to apply data voltages to the data lines; an image pattern determiner configured to determine an image pattern based on an input image signal and to generate image pattern information; and a bias current control signal generator configured to generate a bias current control signal for determining a magnitude of a bias current of the data driver based on the image pattern information.

17 Claims, 19 Drawing Sheets

(56) References Cited

U.S. PATENT DOCUMENTS

| | | | | |
|---|---|---|---|---|
| 2006/0290615 | A1* | 12/2006 | Kim | G09G 3/3216 345/76 |
| 2008/0204822 | A1* | 8/2008 | Yamamoto | H04N 5/335 358/482 |
| 2008/0303809 | A1* | 12/2008 | Lee | G09G 3/3648 345/215 |
| 2008/0307240 | A1 | 12/2008 | Dahan et al. | |
| 2009/0295486 | A1* | 12/2009 | Lee | G09G 3/3688 330/296 |
| 2010/0141493 | A1* | 6/2010 | Cho | G09G 3/20 341/122 |
| 2011/0292024 | A1* | 12/2011 | Baek | G09G 3/2096 345/212 |
| 2012/0026137 | A1 | 2/2012 | Park et al. | |
| 2012/0032935 | A1* | 2/2012 | Yen | G09G 3/20 345/211 |
| 2012/0133635 | A1 | 5/2012 | Ji et al. | |
| 2012/0146720 | A1* | 6/2012 | Hsu | H03F 1/0261 330/69 |
| 2013/0113770 | A1* | 5/2013 | Kang | G09G 3/3614 345/209 |
| 2013/0194251 | A1* | 8/2013 | Cheng | G09G 3/3688 345/213 |

FOREIGN PATENT DOCUMENTS

| | | |
|---|---|---|
| JP | 2007-041155 | 2/2007 |
| JP | 2007-052087 | 3/2007 |

* cited by examiner

FIG. 7

| SAP_SET [3:0] | set1 (μA) | set2 (μA) |
|---|---|---|
| 0000 | 1.00 | 0.5 |
| 0001 | 1.25 | 0.625 |
| 0010 | 1.50 | 0.75 |
| 0011 | 1.75 | 0.875 |
| 0100 | 2.00 | 1 |
| 0101 | 2.25 | 1.125 |
| 0110 (default) | 2.50 | 1.25 |
| 0111 | 2.75 | 1.375 |
| 1000 | 3.00 | 1.5 |
| 1001 | 3.25 | 1.625 |
| 1010 | 3.50 | 1.75 |
| 1011 | 3.75 | 1.875 |
| 1100 | 4.00 | 2 |
| 1101 | 4.25 | 2.125 |
| 1110 | 4.50 | 2.25 |
| 1111 | 4.75 | 2.375 |

FIG. 18

510

| Block | Active (RGB data) period | New standby mode |
|---|---|---|
| Receiver | Normal operation | Disable |
| Bias unit | Normal operation | Normal operation |
| Signal output unit | Normal operation | Disable |
| Data latch unit | Normal operation | Disable |

FIG. 19

560

| Block | Active (RGB data) period | New standby mode |
|---|---|---|
| Output buffer | Normal operation | Disable |
| Bias unit | Normal operation | Normal operation |
| Repair unit | Normal operation | Disable |
| Gray voltage generator | Normal operation | Disable |
| Digital-Analog converter | Normal operation | Disable |

DISPLAY DEVICE AND DRIVING METHOD THEREOF IN WHICH BIAS CURRENT OF DATA DRIVER IS CONTROLLED BASED ON IMAGE PATTERN INFORMATION

CROSS-REFERENCE TO RELATED APPLICATION

This application claims priority from and the benefit of Korean Patent Application No. 10-2014-0015557, filed on Feb. 11, 2014, which is hereby incorporated by reference for all purposes as if fully set forth herein.

BACKGROUND

Field

Exemplary embodiments of the present invention relate to a display device and a driving method thereof. More particularly, exemplary embodiments of the present invention relate to a display device and a driving method thereof, which can reduce power consumption.

Discussion of the Background

A display device, such as a liquid crystal display (LCD) and an organic light emitting diode display, generally includes a display panel and a driving apparatus driving the display panel.

The display panel includes signal lines and pixels connected thereto and arranged substantially in a matrix.

The signal lines include gate lines transferring gate signals, data lines transferring data voltages, and the like.

Each pixel may include at least one switching element connected to the corresponding gate line and the corresponding data line, at least one pixel electrode connected thereto, and an opposed electrode facing the pixel electrode and receiving a common voltage. The switching element may include at least one thin film transistor, and may be turned on or off according to the gate signal transferred by the gate line to selectively transfer the data voltage transferred by the data line to the pixel electrode. Each pixel displays an image at a corresponding luminance according to a difference between the data voltage applied to the pixel electrode and the common voltage.

The driving apparatus includes a gate driver for generating a gate signal, a data driver for generating a data voltage, a signal controller for controlling the drivers, and the like. These drivers may be mounted on the display panel in a form of at least one IC chip, may be attached to the display panel in a form of a tape carrier package ("TCP"), or may be integrated on the display panel.

The driving apparatus may convert a digital input image signal, including gray information inputted from an external system, into an analog image signal by using a gray voltage, and supply it to each pixel, thereby displaying an image. The gray voltages are a voltage set from which the data voltage is selected in response to the gray level of the input image signal, and may vary according to gamma data, which is information for a slope of gray levels and luminance of the image. The data driver selects a gray voltage corresponding to the input image signal among the plurality of gray voltages to apply the selected gray voltage as the data voltage to the data line.

Power consumed in the data driver may be divided into dynamic power generated during charging or discharging of a capacitor when a data voltage is applied to a data line, and static power generated at a bias current serving as a power source for an operation of a data driving circuit.

The above information disclosed in this Background section is only for enhancement of understanding of the background of the invention and, therefore, it may contain information that does not constitute prior art.

SUMMARY

Exemplary embodiments of the present invention provide reduced power consumption, particularly static power consumption, of a data driver.

An exemplary embodiment of the present invention discloses a display device including: a display panel configured to include pixels and data lines; a data driver configured to apply data voltages to the data lines; an image pattern determiner configured to determine an image pattern based on an input image signal and generate image pattern information; and a bias current control signal generator configured to generate a bias current control signal for determining a magnitude of a bias current of the data driver based on the image pattern information.

An exemplary embodiment of the present invention also discloses a display device including: a display panel configured to include pixels and data lines; and a data driver configured to apply data voltages to the data lines. At least one of various driving blocks included in the digital driver, except a bias unit for generating a bias current, is stopped during a first period of one frame.

An exemplary embodiment of the present invention also discloses a method of driving a display device including a display panel configured to include pixels and data lines, a data driver, an image pattern determiner, and a bias current control signal generator, the method including: allowing the image pattern determiner to generate image pattern information by determining an image pattern based on an input image signal; allowing the bias current control signal generator to generate a bias current control signal for determining a magnitude of a bias current of the data driver based on the image pattern information; allowing the data driver to generate a bias current based on the bias current control signal; allowing the data driver to generate a data voltage based on the input image signal; and applying the data voltage to the data lines.

An exemplary embodiment of the present invention also discloses a method of driving a display device including a display panel configured to include pixels and data lines, and a data driver, the method including stopping at least one of various driving blocks included in the digital driver, except a bias unit for generating a bias current, during a first period of one frame It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

FIG. 7 shows parameters relating to a magnitude of a bias current for an operation of an amplifier included in the data driver in accordance with the present exemplary embodiment of the present invention.

FIG. 18 is a table showing an operation state of the digital driver of the data driver during a vertical blank period of various blocks included therein in accordance with yet another exemplary embodiment of the present invention.

FIG. 19 is a table showing an operation state of the analog driver of the data driver during a vertical blank period of various blocks included therein in accordance with the exemplary embodiment of the present invention.

DETAILED DESCRIPTION OF THE ILLUSTRATED EMBODIMENTS

Figure 1:
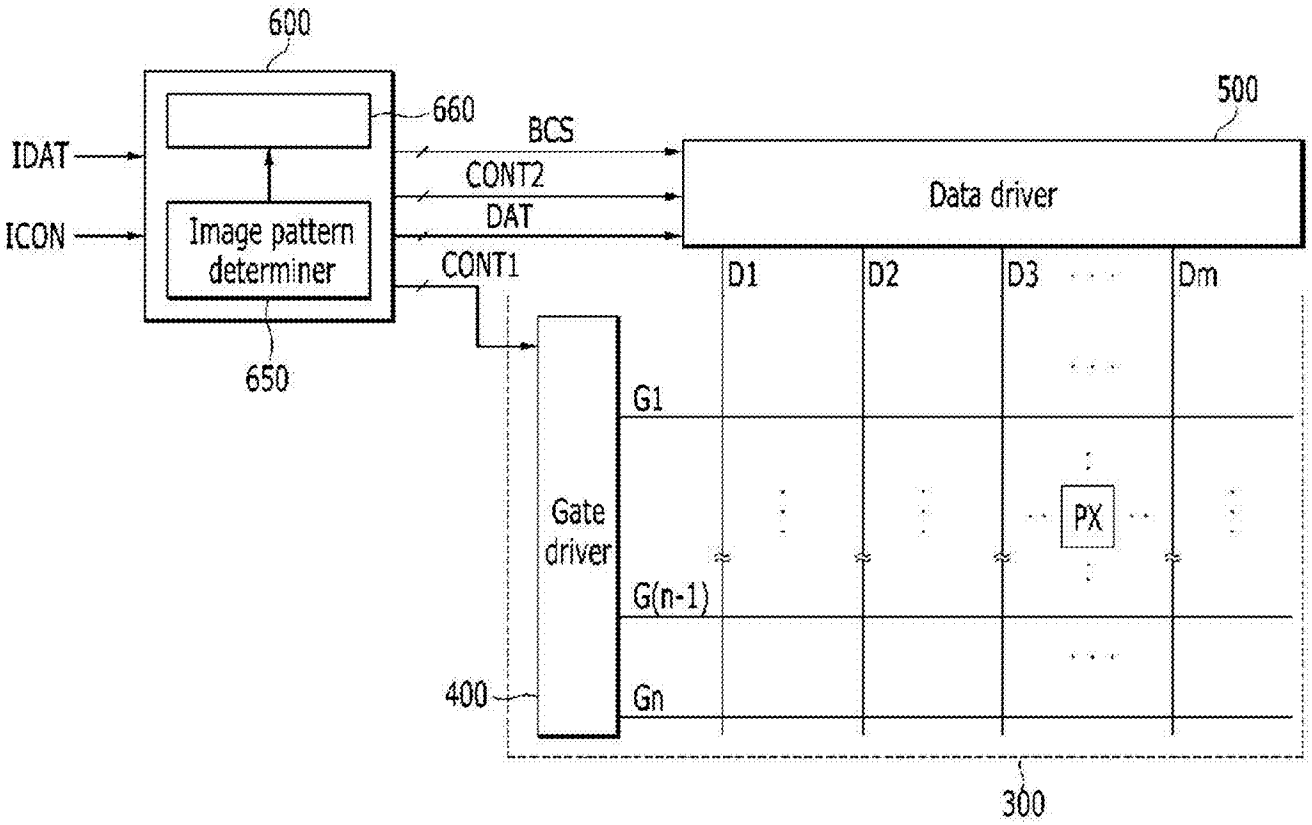
FIG. 1 is a block diagram showing a display device in accordance with an exemplary embodiment of the present invention.

The present invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

It will be understood that when an element or layer is referred to as being "coupled" to another element, the element may be "directly coupled" to the other element or "electrically coupled" to the other element through a third element. It will be understood that for purposes of this disclosure, "at least one of X, Y, and Z" can be construed as X only, Y only, Z only, or any combination of two or more items X, Y, and Z (e.g., XYZ, XYY, YZ, ZZ). In addition, unless explicitly described to the contrary, the word "comprise" and variations such as "comprises" or "comprising" will be understood to imply the inclusion of stated elements but not the exclusion of any other elements.

FIG. 1 is a block diagram showing the display device in accordance with an exemplary embodiment of the present invention.

Referring to FIG. 1, the display device in accordance with the present exemplary embodiment includes a display panel 300, a gate driver 400, a data driver 500, and a signal controller 600 which controls the data driver 500 and the gate driver 400.

The display panel 300 may be included in various flat panel displays (FPDs), such as a liquid crystal display (LCD), an organic light emitting display (OLED), and an electrowetting display (EWD).

The display panel 300 includes gate lines G1 to Gn, a data lines D1 to Dm, and of pixels PXs which are connected to the gate lines G1 to Gn and the data lines D1 to Dm.

The gate lines G1 to Gn may transfer gate signals, and may extend substantially in a row direction and be substantially parallel with each other. The data lines D1 to Dm may transfer a data voltage, and may extend substantially in a column direction and be substantially parallel with each other.

The pixels PXs may be substantially arranged in a matrix. Each pixel PX may include at least one switching element connected to the corresponding gate lines G1 to Gn and the corresponding data lines D1 to Dm, and at least one pixel electrode connected to the switching element. The switching element may include at least one thin film transistor, and is turned on or off depending on the gate signals transferred by the gate lines G1 to Gn, to be able to selectively transfer the data voltage transferred by the data lines D1 to Dm to the pixel electrode. Each pixel PX may display an image of the corresponding luminance, depending on the data voltage applied to the pixel electrode.

Each pixel PX displays one of primary colors (spatial division), or each pixel PX alternately displays the primary colors over time (temporal division) so as to display colors, such that the desired colors may be recognized by the spatial or temporal sum of these primary colors. An example of the primary colors may include three primary colors, such as red, green, and blue. The adjacent pixels PX displaying different primary colors may together form one set (referred to as a dot). One dot may display a white image.

For example, one pixel array can display the same primary color, and adjacent pixel arrays can display different primary colors. In this case, a plurality of pixel arrays that display different primary colors may be alternately disposed in a row direction.

The gate driver 400 receives a gate control signal CONT1 from the signal controller 600, and generates a gate signal, which is a combination of a gate-on voltage Von and a gate-off voltage Voff capable of turning on and turning off the switching element of the pixel PX, based on the transferred gate control signal CONT1. The gate control signal CONT1 includes a scanning start signal STV instructing a scanning start, and at least one clock signal CPV controlling an output period of the gate-on voltage Von, and the like. The gate driver 400 is connected to the gate lines G1 to Gn of the display panel 300 to apply the gate signals to the gate line G1 to Gn.

The data driver 500 receives a data control signal CONT2 and output image signals DAT from the signal controller 600 to select a gray voltage corresponding to each output image signal DAT, thereby converting the output image signal DAT into the data voltage, which is an analog data signal. The output image signal DAT, which is a digital signal, has a defined number of gray values. The data control signal CONT2 includes a horizontal synchronization start signal which informs a transmission start of the output image signal DAT of a pixel PX of one row, at least one data load signal TP and a data clock signal which represent an instruction to apply the data voltage to the data lines D1 to Dm, and the like. The data control signal CONT2 may further include an inversion signal that inverts a polarity of the data voltage for a common voltage Vcom (referred to as polarity of data voltage). The data driver 500 is connected to the data lines D1 to Dm of the display panel 300 to apply a data voltage Vd to the corresponding data lines D1 to Dm.

In place of what is illustrated in FIG. 1, the data driver 500 may also include a pair of data drivers (not illustrated) that face each other at upper and lower portions, and having a display area in which the pixels PX of the display panel 300 are positioned disposed therebetween. In this case, the data driver disposed at the upper portion may apply the data voltage Vd from above the data lines D1 to Dm of the display panel 300, and the data driver disposed at the lower portion may apply the data voltage Vd from under the data lines D1 to Dm of the display panel 300. Further, the data lines D1 to Dm connected to the data driver disposed at the lower portion and the data lines D1 to Dm connected to the data driver disposed at the upper portion, may also be separated from each other.

The signal controller 600 receives an input image signal IDAT and the input control signal ICON controlling the display thereof, from an external graphics processing unit (not illustrated), and the like. The signal controller 600 appropriately processes the input image signal IDAT based on the input image signal (IDAT) and the input control signal (ICON), so as to be converted into the output image signal DAT. The signal controller 600 generates the gate control signal CONT1, the data control signal CONT2, and the like, based on the input image signal IDAT and the input control signal ICON. The signal controller 600 transfers the gate control signal CONT1 to the gate driver 400, and the data control signal CONT2 and the processed output image signal DAT to the data driver 500.

Referring to FIG. 1, the signal controller 600 may include an image pattern determiner 650 and a bias current control signal generator 660.

The image pattern determiner 650 determines an image pattern to be displayed based on an input image signal IDAT inputted from the outside and a structure of the display panel 300. For example, the image pattern determiner 650 can determine whether the image pattern to be displayed is a gray-based image pattern in which the pixels PX display a single gray-based gray level, a pattern of the primary colors R, G, and B in which the pixels PX displays one primary color, or a vertical stripe pattern. In the case of the vertical stripe pattern, a pixel array displaying a black gray level and a pixel array displaying a gray level that is higher than the black gray level may be alternately provided in a row direction.

The bias current control signal generator 660 generates a bias current control signal BCS, based on image pattern information IMP as the result determined by the image pattern determiner 650. In other words, the bias current control signal BCS may be varied depending on the type of the image pattern. The bias current control signal generator 660 will be described later in detail.

Figure 2:
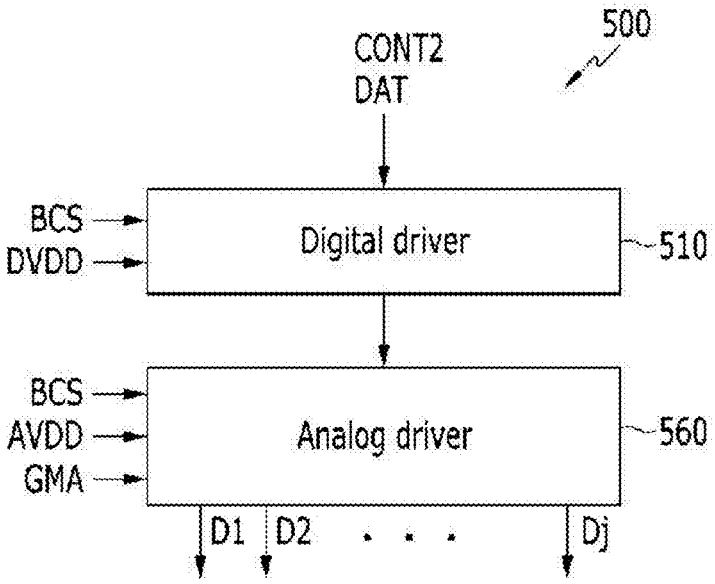
FIG. 2 is a block diagram showing a data driver in accordance with the present exemplary embodiment of the present invention.

FIG. 2 is a block diagram showing the data driver in accordance with the present exemplary embodiment.

Referring to FIG. 2, the data driver 500 includes a digital driver 510 and an analog driver 560.

The digital driver 510 is formed of digital driving circuits, and receives digital signals, e.g., an output image signal DAT and a data control signal CONT2, from the signal controller 600. The driving circuits of the digital driver 510 may be driven by a first driving voltage DVDD.

The analog driver 560 is formed of analog driving circuits. The analog driver 560 receives a plurality of gray reference voltages GMA from an external circuit, such as a gray reference voltage generator (not shown) for generating a gray reference voltage, and converts a digital signal inputted from the digital driver 510 into an analog data signal, i.e., a data voltage, based on the gray reference voltages. The analog driver 560 may be driven by the second driving voltage AVDD. The second driving voltage AVDD may be higher than the first driving voltage DVDD.

At least one of the digital driver 510 and the analog driver 560 may receive the bias current control signal BCS from the signal controller 600, and generates a bias current for facilitating stable operation of an amplifier based on the bias current control signal BCS.

Figure 3:
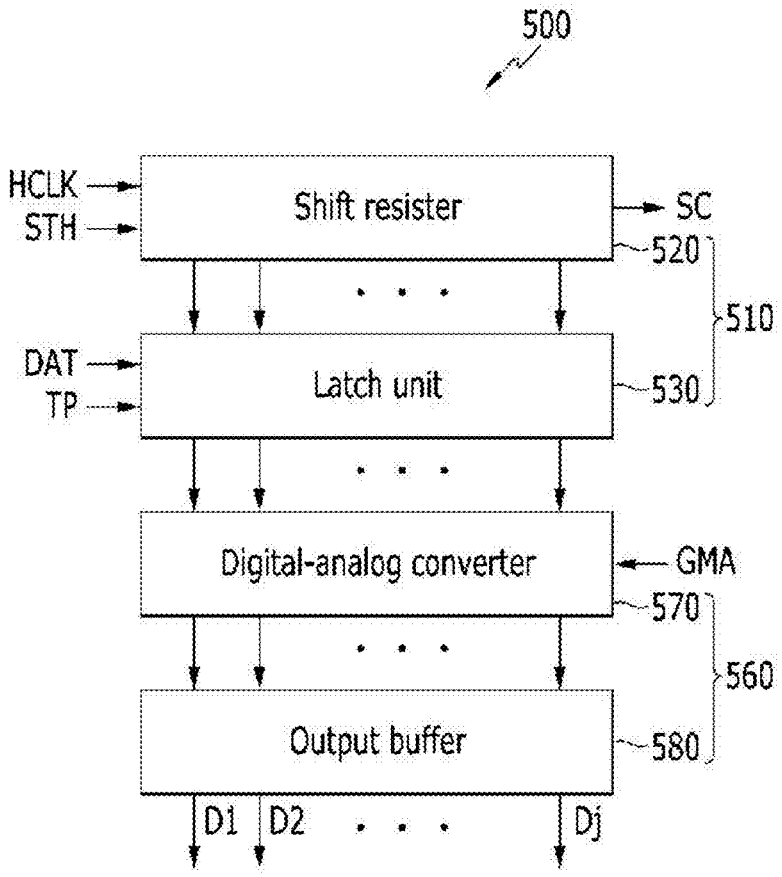
FIG. 3 is a block diagram showing a data driver in accordance with the present exemplary embodiment of the present invention.

FIG. 3 is a block diagram showing the data driver in accordance with the present exemplary embodiment.

Referring to FIG. 3, the digital driver 510 may include, e.g., a shift register 520 and a latch unit 530.

When receiving a horizontal synchronization start signal STH (or shift clock signal), the shift register 520 generates a latch pulse according to a data clock signal HCLK and outputs it to the latch unit 530. In the case that the data driver 500 includes data driving circuits, the shift register 520 may send a shift clock signal to the shift register 520 of an adjacent data driving circuit after the latch unit 530 latches all corresponding output image signals DAT.

The latch unit 530 sequentially receives the output image signals DAT from the signal controller 600 to temporarily store and latch it. Then, the latch unit 530 simultaneously outputs the output image signals DAT latched according to a data load signal TP.

The analog driver 560 may include, e.g., a digital-analog converter 570 and an output buffer 580.

The digital-analog converter 570 receives the gray reference voltage GMA and converts the output image signals DAT into a data voltage as an analog data signal by using the output image signals DAT to send it to the output buffer 580. The data voltage has a positive value or a negative value with respect to the common voltage Vcom.

The output buffer 580 amplifies the data voltage inputted from the digital-analog converter 570, and outputs it to the data lines D1-Dj of the display panel 300 connected to the data driver 500.

Hereinafter, detailed structures of the digital driver 510 and the analog driver 560 included in the data driver 500 in accordance with the present exemplary embodiment will be exemplarily described with reference to FIG. 4 and FIG. 5.

Figure 4:
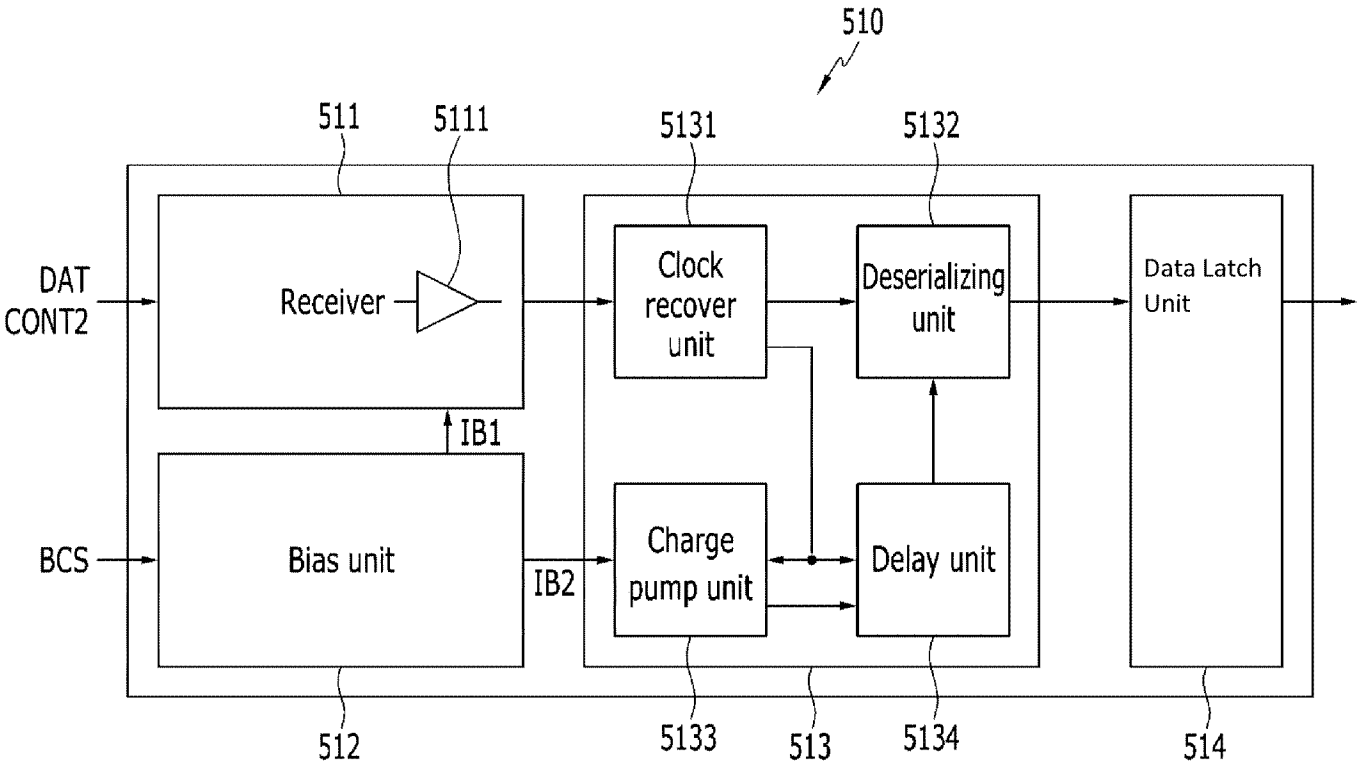
FIG. 4 is a block diagram showing a digital driver of the data driver in accordance with the present exemplary embodiment of the present invention.

FIG. 4 is a block diagram showing the digital driver of the data driver in accordance with the present exemplary embodiment.

Referring to FIG. 4, the digital driver 510 of the data driver 500 may include a driving circuit that is divided into various blocks, for example, a receiver 511, a bias unit 512, a signal output unit 513, a data latch unit 514, and the like. At least one of the blocks of the digital driver 510 may include at least one amplifier.

The bias unit 512 generates bias currents IB1 and IB2 that have optimized magnitudes according to image pattern types based on the bias current control signals BCS inputted from the signal controller 600. The bias unit 512 may transfer the bias current IB1 to the receiver 511, and the bias current IB2 to the signal output unit 513.

The receiver 511 receives digital data, such as the output image signal DAT and the data control signal CONT2, from the signal controller 600. The receiver 511 adjusts a level of the digital data and transfers it to the signal output unit 513. The receiver 511 may include at least one amplifier 5111, and the amplifier 5111 may be operated by receiving a bias voltage according to the bias current IB1.

The signal output unit 513 may include a clock recover unit 5131, a deserializing unit 5132, a charge pump unit 5133, a delay unit 5134, and the like.

The clock recover unit 5131 may receive digital data from the receiver 511 and generate a recover clock signal based on the digital data. Further, the clock recover unit 5131 may generate a multiple phase clock signal based on the recover clock signal. The clock recover unit 5131 may transfer the output image signal DAT and the multiple phase clock signal to the deserializing unit 5132. The clock recover unit 5131 may transfer the recover clock signal to the charge pump unit 5133 and the delay unit 5134

The delay unit 5134 may receive the recover clock signal from the clock recover unit 5131, and delay the recover clock signal by using a delay locked loop (DLL) to generate an internal clock signal.

The deserializing unit 5132 may sample and deserialize the output image signal DAT and the data control signal CONT2, based on the recovered internal clock signal. The deserializing unit 5132 may transfer the deserialized digital data to the data latch unit 514.

The charge pump unit 5133 may receive the recover clock signal from the clock recover unit 5131, and adjust its voltage level to transfer it to the delay unit 5134. The charge pump unit 5133 may include an amplifier (not shown), and the amplifier may be operated by receiving a bias voltage according to the bias current IB2.

The data latch unit 514 outputs the output image signal DAT to the analog driver 560 according to the data load signal TP.

Figure 5:
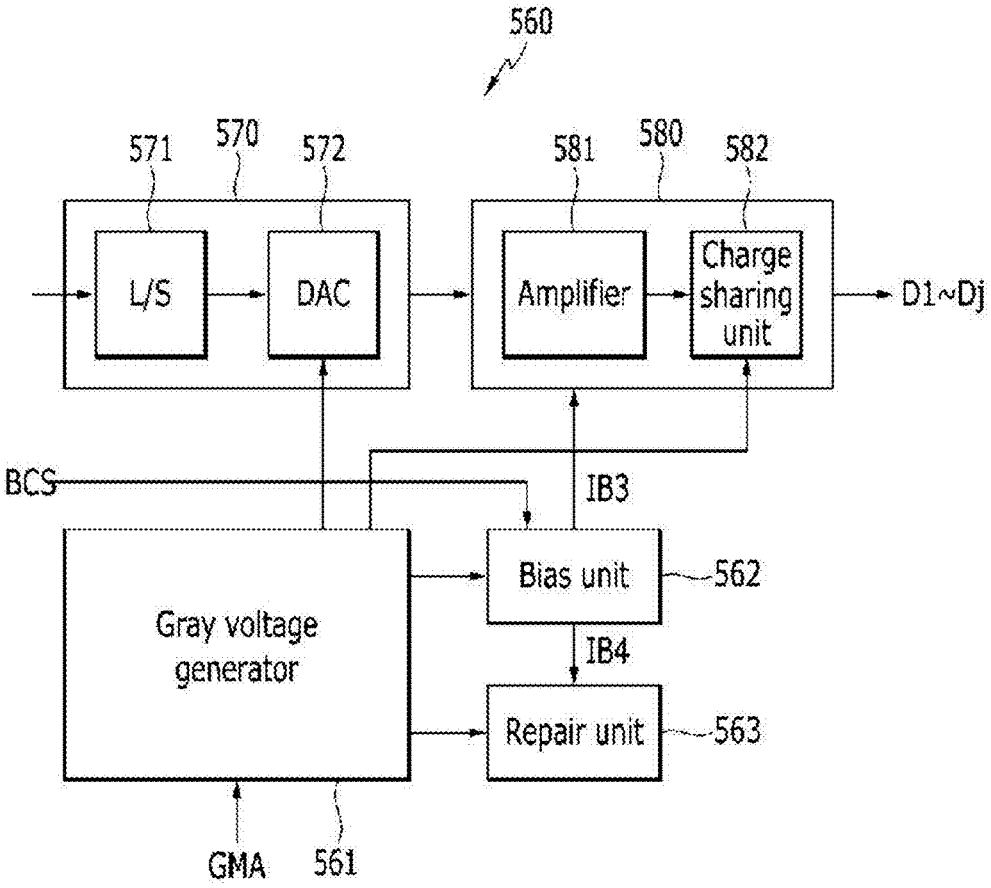
FIG. 5 is a block diagram showing an analog driver of the data driver in accordance with the present exemplary embodiment of the present invention.

FIG. 5 is a block diagram showing an analog driver of the data driver in accordance with the present exemplary embodiment.

Referring to FIG. 5, the analog driver 560 of the data driver 500 may include a driving circuit that is divided into various blocks, for example, a gray voltage generator 561, a bias unit 562, a repair unit 563, a digital-analog converter 570, and an output buffer 580. At least one of the blocks of the analog driver 560 may include at least one amplifier.

The gray voltage generator 561 may receive gray reference voltages GMA from the outside, and generate gray voltages by dividing the gray reference voltages GMA.

The digital-analog converter 570 may include a level shifter 571 and a D/A converter 572. The level shifter 571 adjusts a level of the output image signal DAT inputted from the digital driver 510 and transfers it to the D/A converter 572, and the D/A converter 572 converts the output image signal DAT into a data voltage as an analog data signal by using gray voltages inputted from the gray voltage generator 561.

The bias unit 562 generates bias currents IB3 and IB4 of optimized magnitudes according to image pattern types based on the bias current control signals BCS inputted from the signal controller 600. The bias unit 562 may transfer the bias current IB3 to the output buffer 580, and may output the bias current IB4 to the repair unit 563.

The output buffer 580 may include an amplifier 581 and a charge sharing unit 582. The amplifier 581 amplifies and outputs the data voltage inputted from the digital-analog converter 570. The amplifier 581 may be operated by receiving the bias voltage according to the bias current IB3. The charge sharing unit 582 may connect the output terminals to each other according to an additional enable signal during a charge sharing period to transfer a sharing voltage or a common voltage to the data lines D1-Dj.

The repair unit 563 may buffer the data voltage corresponding to one of data lines D1-Dj at which a defect, such as a disconnection, is generated. The repair unit 563 may include at least one amplifier (not shown), and the amplifier may be operated by receiving the bias voltage according to a bias current IB4.

Hereinafter, the bias current control signal generator 660 will be described with reference to FIG. 6 and FIG. 7, as well as the aforementioned drawings.

Figure 6:
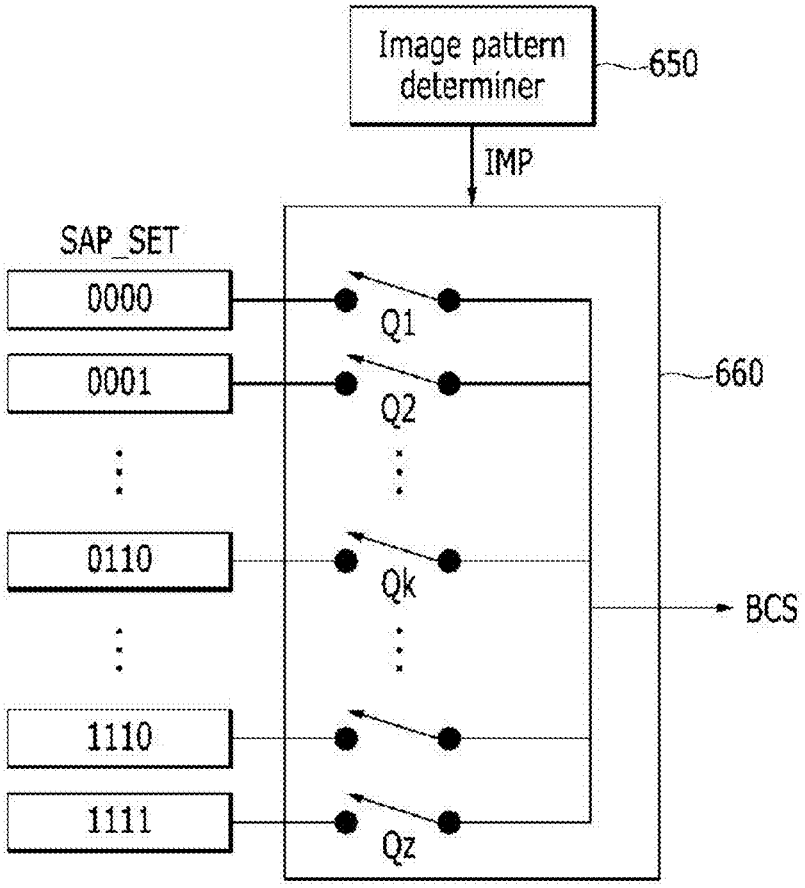
FIG. 6 is a block diagram showing a signal controller of the display device in accordance with the present exemplary embodiment of the present invention.

FIG. 6 is a block diagram showing the signal controller of the display device in accordance with the present exemplary embodiment, and FIG. 7 shows parameters relating to a magnitude of a bias current for an operation of the amplifier included in the data driver in accordance with the present exemplary embodiment.

Referring to FIG. 6, the signal controller 600 may include the image pattern determiner 650 and the bias current control signal generator 660.

The bias current for operating the amplifier included in the data driver 500 may be adjusted according to a parameter SAP_SET. Referring to FIG. 6 and FIG. 7, the parameter SAP_SET may be formed of a predetermined number of bits, e.g., 4 bits.

Referring to FIG. 7, a magnitude of the bias current may be determined according to the parameter SAT_SET and its dependent sets set1 and set2. For example, when the parameter SAP_SET is [0000], the magnitude of the bias current is determined to be a minimum, and when the parameter SAP_SET is [1111], the magnitude of the bias current is determined to be a maximum. As a value of the parameter SAP_SET is increased, the magnitude of the bias current may be determined to be larger. Further, one parameter SAP_SET may correspond to the magnitude of the bias current of a plurality of sets, and a value of the second set set2 may be substantially half of a value of the first set set1. Alternatively, each parameter SAP_SET may correspond to one set. A default value may be appropriately selected. For example, [0110] may be determined to be a default value.

Referring to FIG. 6, the bias current control signal generator 660 may select the parameter SAP_SET that is optimized according to the image pattern determined by the image pattern determiner 650, and output it as the bias current control signal BCS.

The bias current control signal generator 660 may include switches Q1, Q2, . . . , Qk, . . . , Qz according to the number of parameters SAP_SET. The switches Q1, Q2, . . . , Qk, . . . , Qz may sequentially correspond to the parameter SAP_SET that is gradually increased or decreased.

At least one of the switches Q1, Q2, . . . , Qk, . . . , Qz may be switched on according to the image pattern information IMP determined by the image pattern determiner 650. For example, when the pixels PX display a gray-based image pattern, the switch Q1 may be switched on to output the parameter SAP_SET of [0000] as the bias current control signal BCS. For example, when the pixels PX display a pattern of the primary colors R, G, and B, the switch Qk may be switched on to output the parameter SAP_SET of [0110] as the bias current control signal BCS. For example, when the pixels PX display the vertical stripe pattern, the switch Qk may be switched on to output the parameter SAP_SET of [1111] as the bias current control signal BCS.

As such, when selecting the magnitude of the bias current of the data driver according to the type of image pattern, static power consumption can be reduced when an image pattern, which can be stably displayed even by using a small bias current, is displayed. Furthermore, a stable operation of the data driver 500 can be performed by supplying a sufficiently large bias current when an image pattern requiring a large bias current is displayed. This will be described in more detail later.

Hereinafter, method of driving the display device in accordance with the present exemplary embodiment will be described with reference to FIG. 8 to FIG. 13, as well as the aforementioned drawings.

Figure 8:
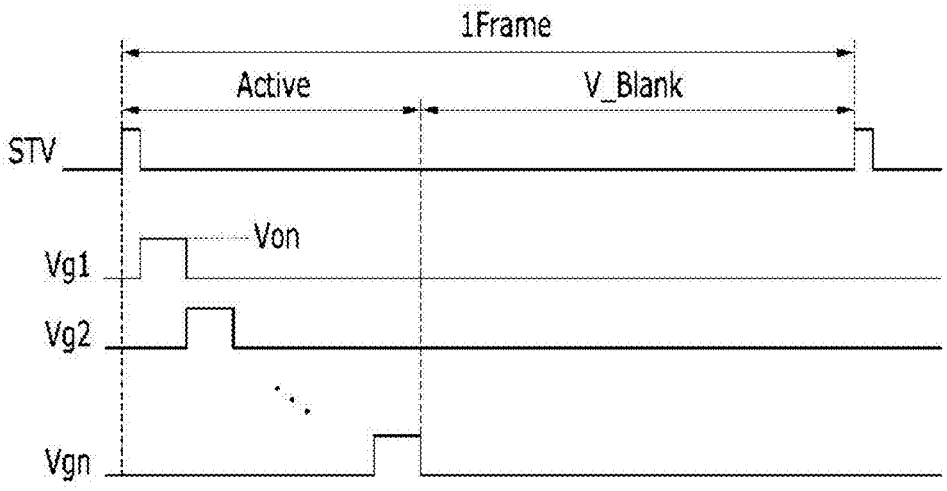
FIG. 8 is a timing diagram showing a driving signal of the display device in accordance with the present exemplary embodiment of the present invention.

Referring to FIG. 8, the gate driver 400 sequentially applies gate signals Vg1, Vg2, . . . , Vgn to the gate lines G1-Gn of the display panel 300 in a cycle of one horizontal period 1H according to a pulse of the vertical synchronization signal STV. The gate signals Vg1, Vg2, . . . , Vgn include gate-on pulses formed of gate-on voltages Von.

The application of the gate signals Vg1, Vg2, . . . , Vgn can be performed during an active period of one frame during which the pixels PX are charged with the data voltage. The remaining period of one frame, except the active period, is referred to as a vertical blank period V_Blank. During the vertical blank period V_Blank, the gate-on pulses are not applied to the gate lines G1-Gn, and the pixels PX can maintain the data voltage that is applied during the active period.

Referring to FIG. 9 to FIG. 13, when the gate-on voltages Von are applied to the gate lines G1-Gn, the switching elements of the pixels PX connected thereto are turned on, and the data voltages of the data lines D1-Dm are applied to the pixels PX through the turned-on switching elements. The data voltages may have magnitudes ranging between the driving voltage AVDD and the ground voltage VSS.

The polarity of the data voltage applied to each of the data lines D1-Dm during one frame for the common voltage Vcom may be constant. Further, the polarity of the data voltage applied to adjacent data lines D1-Dm may be opposite to each other. This is referred to as a column inversion driving method.

According to this column inversion driving method, in the case of the display panel 300 in which the pixels PX located at one pixel array are alternately connected to two adjacent data lines in each pixel row, the adjacent pixels PX located at one pixel array may be charged with data voltages with different polarities. For example, as in the examples shown in FIG. 9 and FIG. 10, or in FIG. 12 and FIG. 13, when the pixels PX located at one pixel array are alternately connected to two adjacent data lines in each pixel row, the pixels PX that are adjacently located in the row or column direction may be charged with data voltages with different polarities. Accordingly, an image can be displayed in a form of 1×1 dot inversion.

Figure 9:
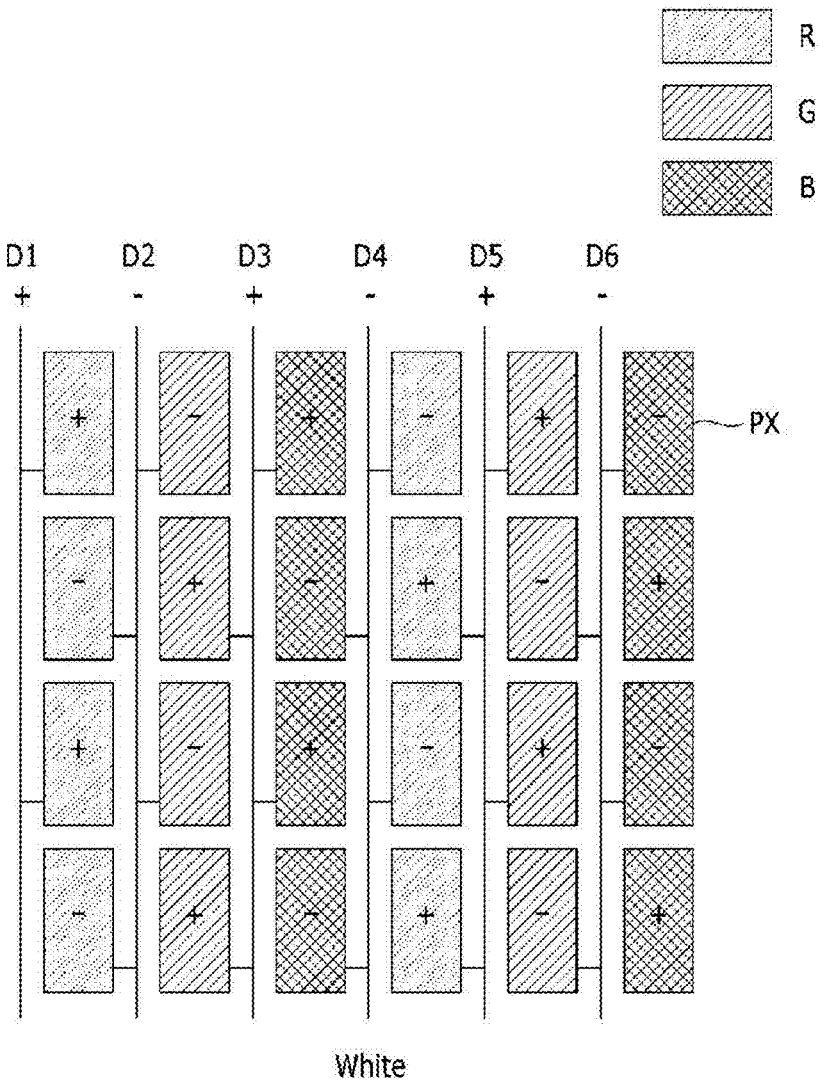
FIG. 9 is a layout view showing luminance of each pixel when white is displayed by the display device in accordance with the present exemplary embodiment of the present invention.
Figure 10:
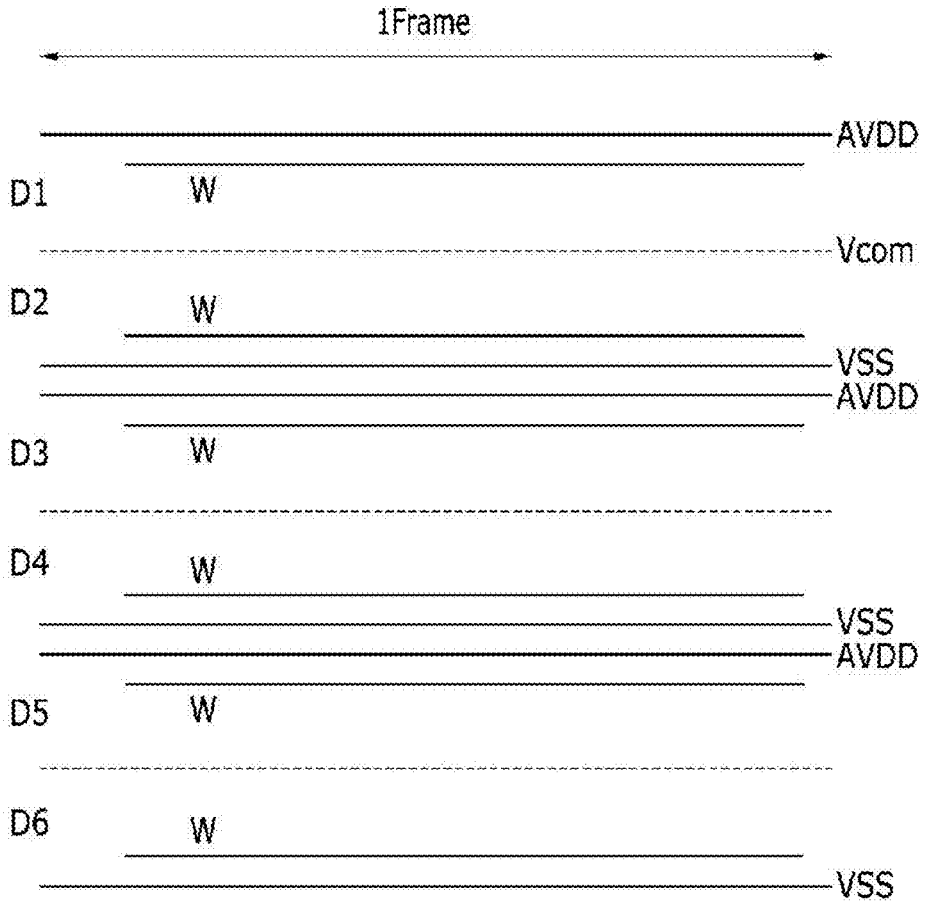
FIG. 10 is a waveform diagram showing a level of a data voltage applied to a data line when an image of FIG. 9 is displayed by the display device in accordance with the present exemplary embodiment of the present invention.

In particular, FIG. 9 and FIG. 10 show an example in which an image of a gray-based image pattern, such as white and black, is displayed in the display panel 300 in which the pixels PX located at one pixel array are alternately connected to two adjacent data lines in each pixel row. In other words, a data voltage indicating a predetermined luminance can be applied to the pixels PX of the pixel array displaying all the primary colors R, G, and B. FIG. 9 shows an example in which the display panel 300 displays white, while FIG. 10 shows that a white data voltage W indicating white is applied to each of the data lines D1-D6.

In this case, as shown in FIG. 10, the data voltage outputted from the output buffer 580 of the data driver 500 is constant during at least one frame, and thus, dynamic power consumption is very low. In other words, most of the power consumption in the data driver 500 during the active period Active and the vertical blank period V_Blank of one frame is static power consumption.

As such, when an image of a pattern having dynamic power consumption that is very low is displayed in consideration of the structure of the display panel 300, a large bias current is not required for stable operation of the data driver 500. Accordingly, the bias current control signal generator 660 can determine a bias current of the digital driver 510 and the analog driver 560 of the data driver 500 as a minimum by selecting a small parameter SAP_SET, e.g., [0000]. Accordingly, it is possible to reduce the power consumption of the data driver 500.

Figure 11:
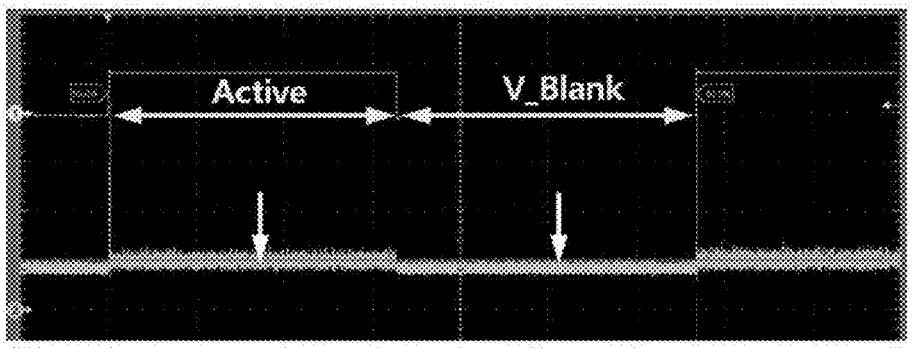
FIG. 11 is a graph showing power consumed in a data driver when the display device displays a single gray-based gray such as white or black in accordance with the present exemplary embodiment of the present invention.

Referring to FIG. 11, for the structure of the display panel 300 in which the pixels PX located at one pixel array are alternately connected to two adjacent data lines in each pixel row, it is possible to reduce the static power consumption that represents most of the power consumption in the data driver 500 during the active period Active and the vertical blank period V_Blank of one frame, as indicated by arrows, by determining the bias current as a small value when an image pattern is a gray pattern.

Figure 12:
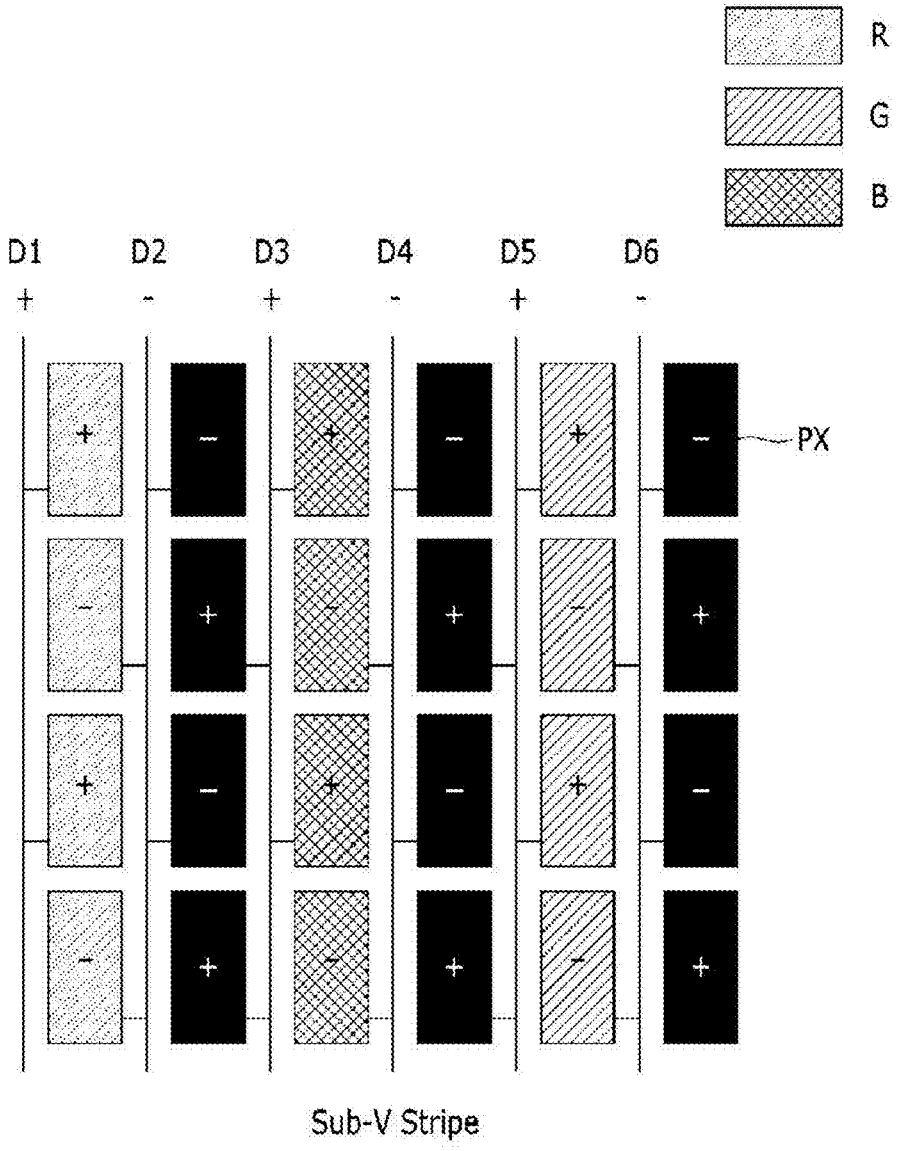
FIG. 12 is a layout view showing luminance of each pixel when the display device displays a vertical stripe pattern in accordance with the present exemplary embodiment of the present invention.
Figure 13:
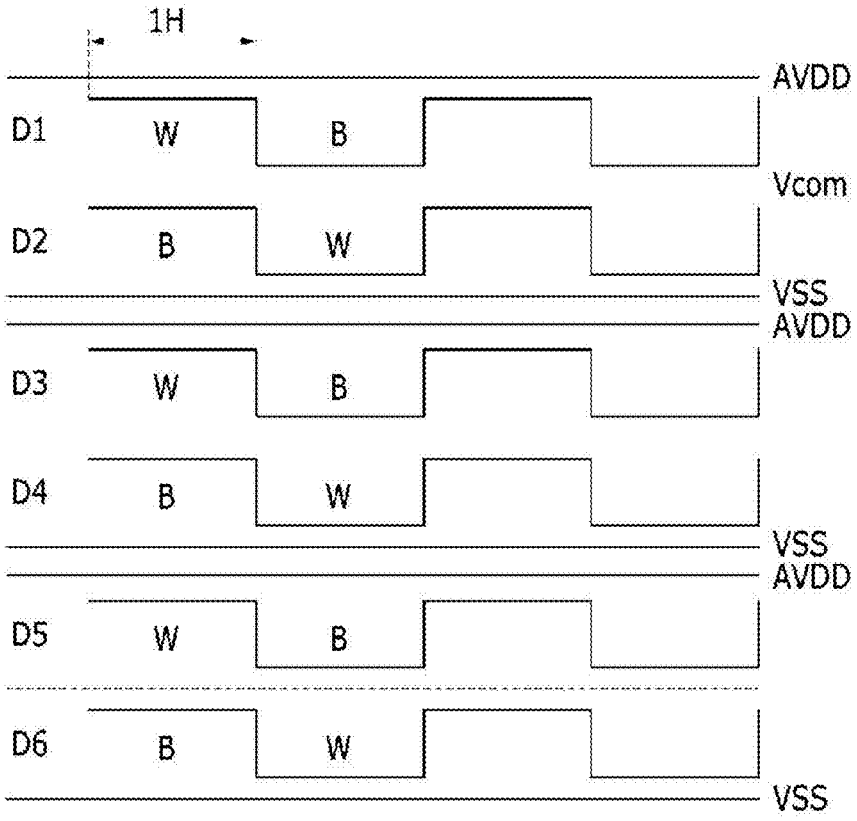
FIG. 13 is a waveform diagram showing a level of a data voltage applied to a data line when the display device displays the image shown in FIG. 11.
Figure 14:
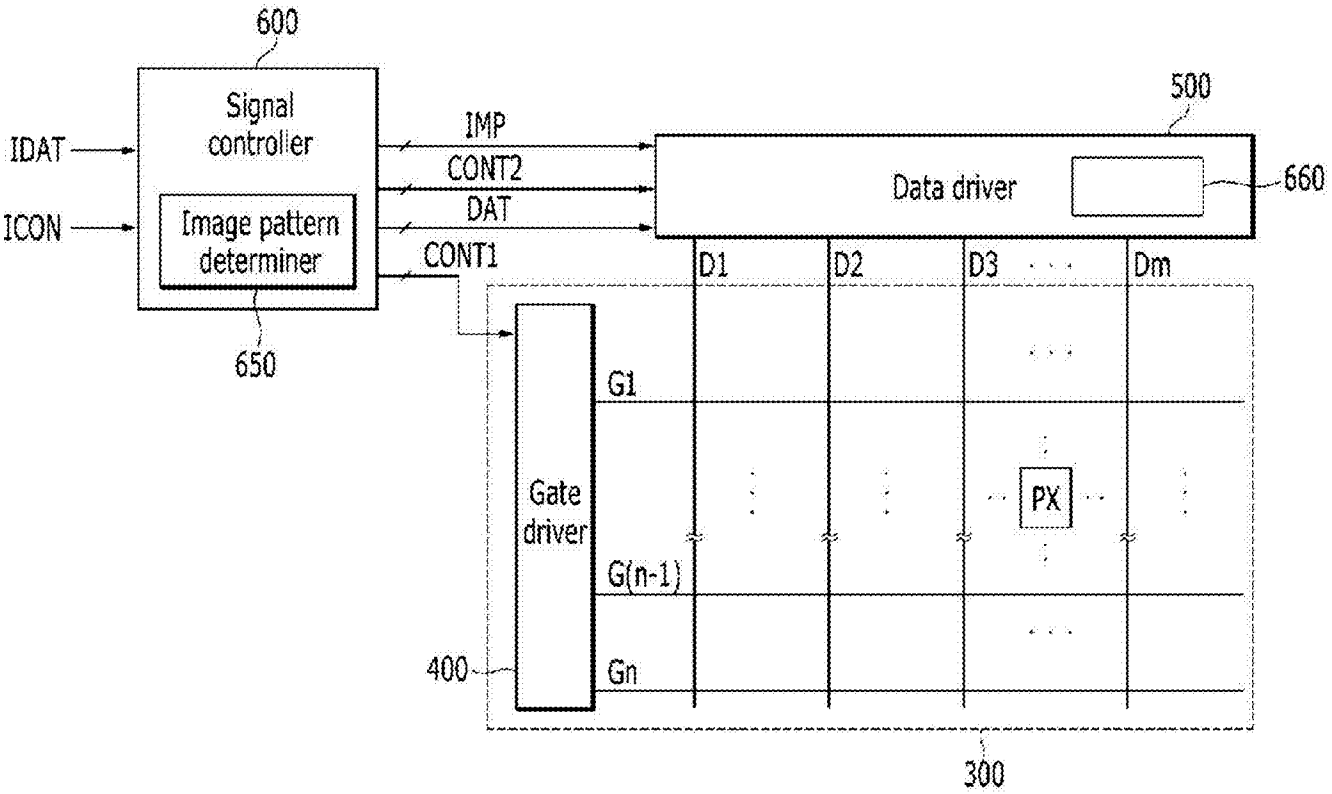
FIG. 14 is a block diagram showing the display device in accordance with another exemplary embodiment of the present invention.

FIG. 12 and FIG. 13 show an example in which an image of a vertical stripe pattern Sub-V Stripe in which a pixel array displaying a black gray level and a pixel array displaying a gray level that is higher than the black gray level are alternately provided in a row direction. In other words, the description will be made by taking an image in which the pixel array displaying a predetermined luminance (e.g., white gray level) and the pixel array displaying the black gray level are alternately provided as an example.

In this case, as shown in FIG. 13, the data voltage of one of data lines D1-Dm outputted from the output buffer 580 of the data driver 500 swings between a white data voltage W displaying white per 1 horizontal period 1H and a black data voltage B displaying black. Thus, the dynamic power consumption is relatively very high. In other words, the power consumption in the active period Active of one frame by the data driver 500 is mostly the dynamic power consumption, while the power consumption in the vertical blank period V_Blank by the data driver 500 is mostly the static power consumption.

As such, in the case of displaying an image of a pattern having very high static power consumption in consideration of the structure of the display panel 300, the data driver 500 requires a large bias current for stable operation in the active period Active. Accordingly, the bias current control signal generator 660 can determine a bias current of the digital driver 510 and the analog driver 560 of the data driver 500 to be large by selecting a large parameter SAP_SET, e.g., [1111], thereby stably outputting the data voltage.

As a result, it is possible to reduce the power consumption of the data driver 500 by optimally adjusting the magnitude of the bias current used by the data driver 500 according to a ratio of the static power consumption to the entire power consumption, i.e., a specific image pattern corresponding to the structure of the display panel 300.

Hereinafter, a display device and a driving method thereof in accordance with another exemplary embodiment of the present invention will be described with reference to FIG. 14 to FIG. 17 as well as the aforementioned drawings.

Referring to FIG. 14 to FIG. 17, the display device of the present exemplary embodiment is mostly the same as the display device described with reference to FIG. 1, but the bias current control signal generator 660 may be included in the data driver 500 instead of being included in the signal controller 600.

Figure 15:
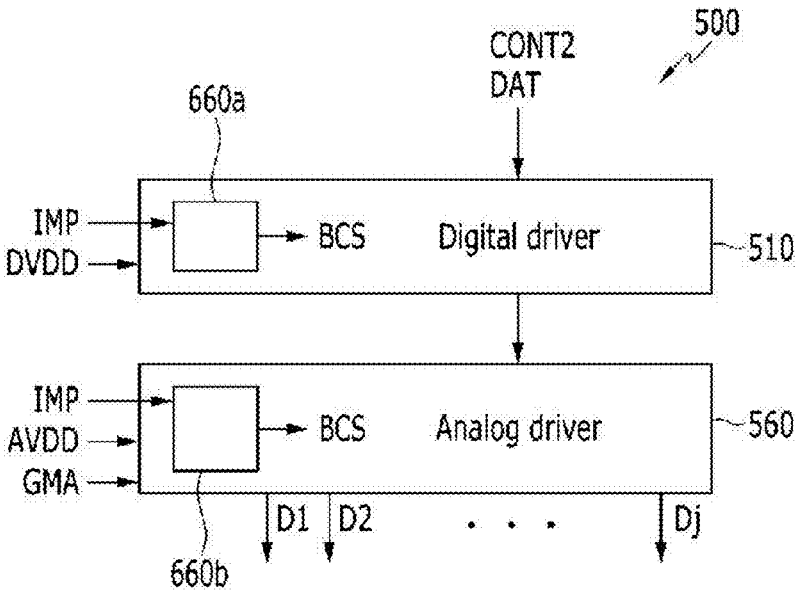
FIG. 15 is a block diagram showing the data driver in accordance with the present exemplary embodiment of the present invention.

Specifically, at least one of the digital driver 510 and the analog driver 560 of the data driver 500 includes bias current control signal generators 660*a* and 660*b*. FIG. 15 shows an example in which the digital driver 510 includes the bias current control signal generator 660*a*, and the analog driver 560 includes the bias current control signal generator 660*b*.

The bias current control signal generators 660*a* and 660*b* can receive the image pattern information IMP from the image pattern determiner 650 of the signal controller 600, and generate the bias current control signal BCS based on the image pattern information IMP. Each of the digital driver 510 and the analog driver 560 can generate a bias current required for the amplifier based on the bias current control signal BCS.

Figure 16:
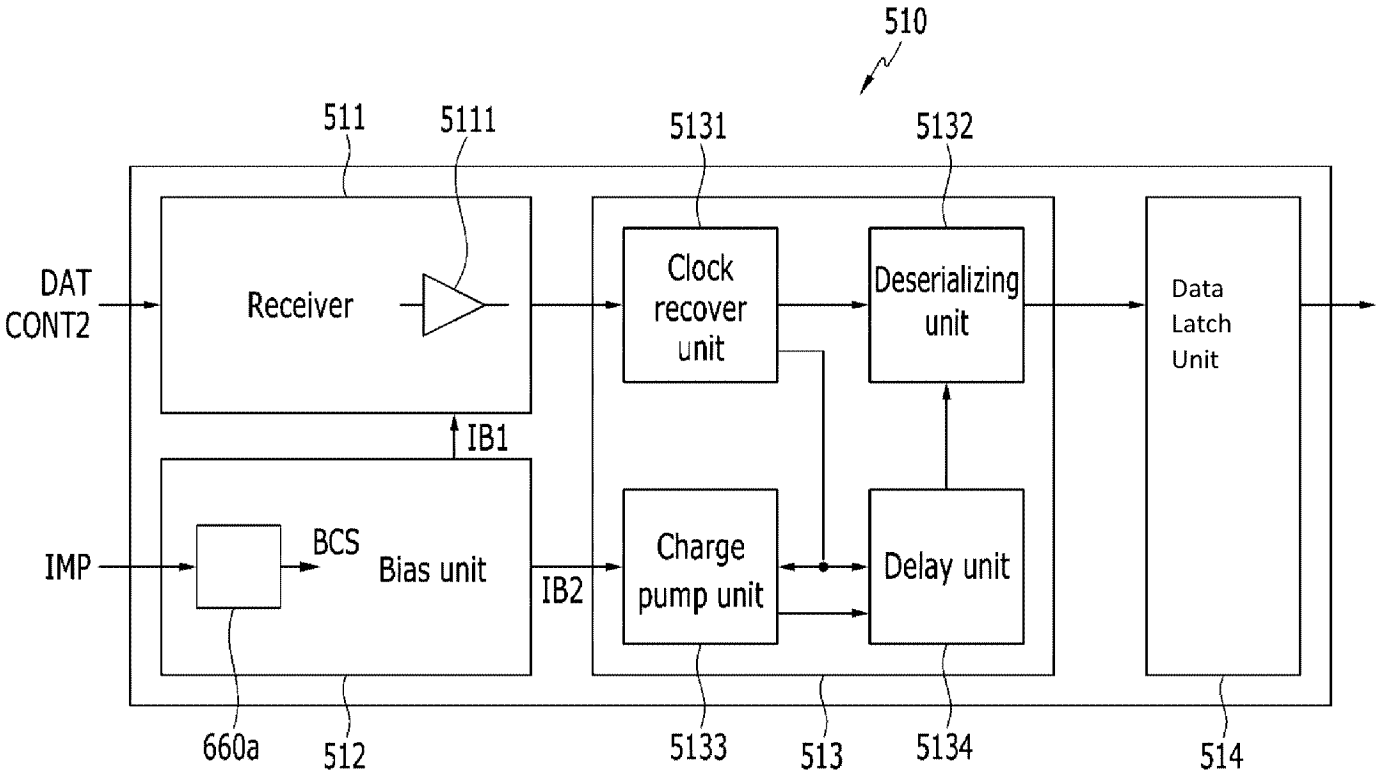
FIG. 16 is a block diagram showing a digital driver of the data driver in accordance with the present exemplary embodiment of the present invention.

In more detail, referring to FIG. 16, the bias unit 512 may include the bias current control signal generator 660*a* and directly generate the bias current control signal BCS based on the image pattern information IMP to adjust the magnitude of the bias current.

Figure 17:
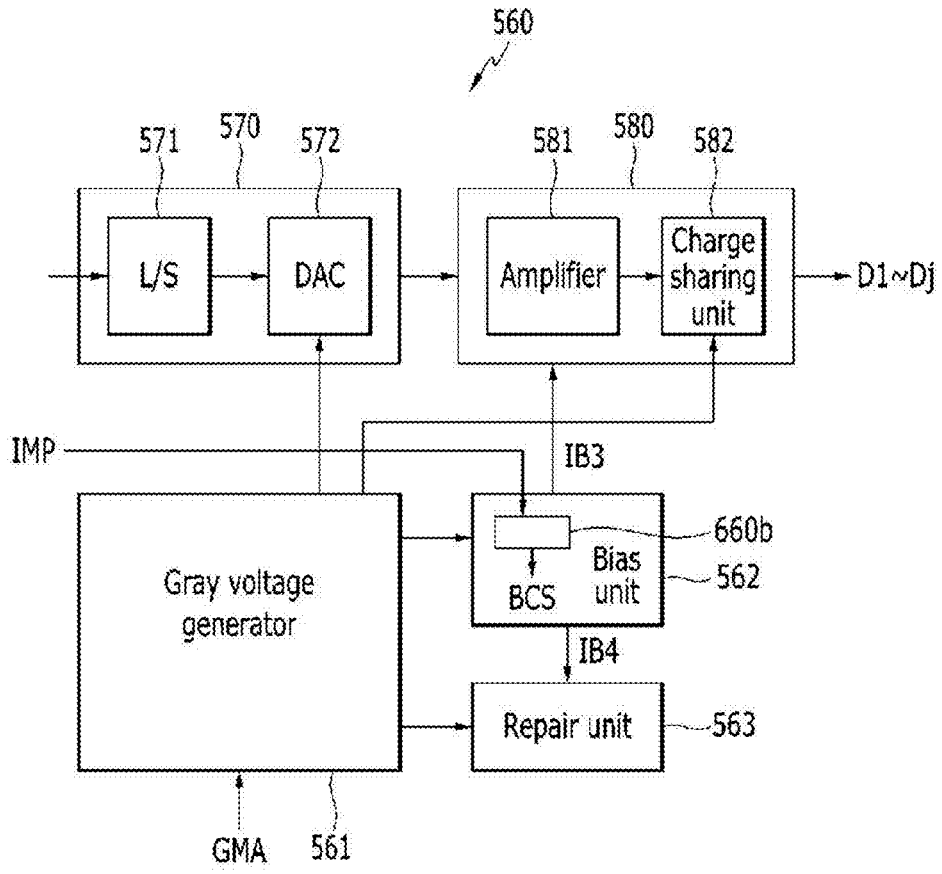
FIG. 17 is a block diagram showing an operation state of the analog driver of the data driver during a vertical blank period of various blocks included therein in accordance with the present exemplary embodiment of the present invention.

Referring to FIG. 17, the bias unit 562 of the analog driver 560 may include the bias current control signal generator 660*b*, and may directly generate the bias current control signal BCS based on the image pattern information IMP to adjust the magnitude of the bias current.

In addition, many features and effects of the exemplary embodiment described above may be equally applied to the present exemplary embodiment.

Hereinafter, a display device and a driving method thereof in accordance with yet another exemplary embodiment of the present invention will be described with reference to FIG. 18 to FIG. 21 as well as the aforementioned drawings.

Because the display device and the driving method thereof in accordance with the exemplary embodiment are almost the same as the exemplary embodiment shown in FIGS. 1 to 17 described above, differences will be mainly described.

Referring to FIG. 18, as well as the aforementioned FIG. 4, at least one of various driving blocks included in the digital driver 510 of the data driver 500 during a specific period of one frame may be stopped, except for the bias unit 512 that is required to generate a bias current for stable operation of the amplifier among various blocks. For example, at least one of various driving blocks included in the digital driver 510 of the data driver 500 during the vertical blank block V_Blank of one frame during which no data voltage is applied to the pixels PX may be stopped, except the bias unit 512. FIG. 18 shows an example in which all of the receiver 511, the signal output unit 513, and the data latch unit 514 included in the digital driver 510 are stopped during the vertical blank period V_Blank.

Referring to FIG. 19, as well as the aforementioned FIG. 5, at least one of various driving blocks included in the analog driver 560 of the data driver 500 during a specific period of one frame may be stopped, except for the bias unit 562 that is required to generate a bias current for stable operation of the amplifier among various blocks. For example, at least one of various driving blocks included in the analog driver 560 of the data driver 500 during the vertical blank block V_Blank of one frame during which no data voltage is applied to the pixels PX may be stopped, except the bias unit 562. FIG. 19 shows an example in which all of the gray voltage generator 561, the repair unit 563, the digital-analog converter 570, and the output buffer 580 included in the analog driver 560 are stopped during the vertical blank period V_Blank.

In the present exemplary embodiment, to reduce the static power consumption, the bias current can be optimally adjusted according to the image pattern as in the aforementioned exemplary embodiment. Although unlikely, the bias current can be constantly maintained regardless of the image pattern. In other words, in accordance with another exemplary embodiment of the present invention, the aforementioned image pattern determiner 650 and bias current control signal generator 660, and the like, may be omitted.

Figure 20:
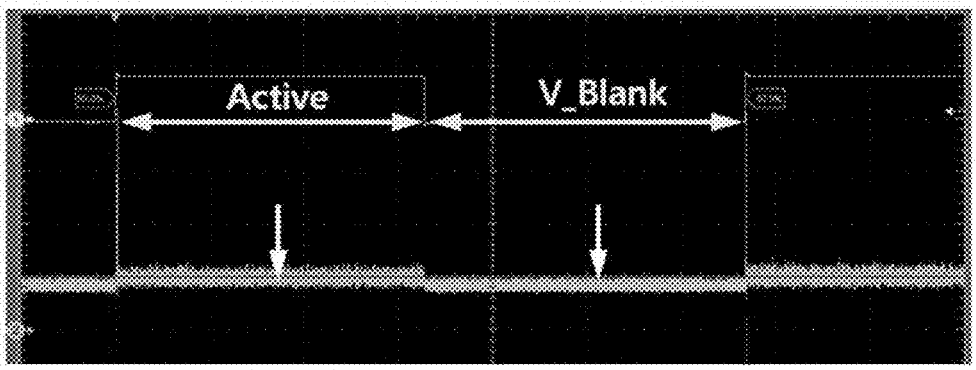
FIG. 20 is a graph showing a power consumed in a data driver when the display device displays a single gray-based gray value, such as white or black, in accordance with yet another exemplary embodiment of the present invention.
Figure 21:
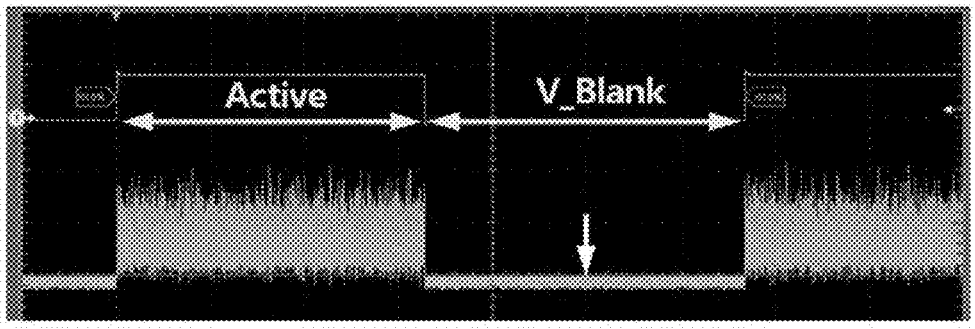
FIG. 21 is a graph showing power consumed in the data driver when the display device displays the vertical stripe pattern in accordance with the present exemplary embodiment.

FIG. 20 is a graph showing power consumed in a data driver when the display device displays a single gray-based gray level, such as white or black, in accordance with yet another exemplary embodiment of the present invention, and FIG. 21 is a graph showing power consumed in the data driver when the display device displays the vertical stripe pattern in accordance with the present exemplary embodiment.

Referring to FIG. 20, when an image of a gray-based image pattern is displayed, it is possible to further reduce the static power consumption as indicated by arrows at the vertical blank period V_Blank by normally operating only the bias unit that is required to be turned on for the stable operation of the data driver 500 during the vertical blank period V_Blank, and stopping the remaining driving blocks.

Similarly, referring to FIG. 21, when an image of a primary color pattern or a vertical stripe pattern is displayed, it is possible to further reduce the static power consumption as indicated by arrows at the vertical blank period V_Blank by normally operating only the bias unit that is required to be turned on for the stable operation of the data driver 500, during the vertical blank period V_Blank, and stopping the remaining driving blocks.

As a result, it is possible to reduce the static power consumption of the data driver 500 by normally operating only the bias unit and stopping the remaining driving blocks during the vertical blank period V_Blank. This may be performed simultaneously or independently with the method of adjusting the bias current according to the structure of the display panel the image pattern type as in the aforementioned exemplary embodiment.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

What is claimed is:

1. A display device comprising:

a display panel comprising a plurality of rows of pixels and data lines;

an image pattern determiner configured to receive an input image signal of a frame, determine a type of an image pattern to be displayed on the display panel for the entire plurality of rows of pixels based on an the input image signal and generate an image pattern information about the type of the image pattern for the frame, the type of the image pattern being dependent on a degree of a dynamic power consumption;

a data driver configured to receive an output image signal and generate data voltages to be supplied to the data lines based on the output image signal, the data driver comprising a digital to analog converter for converting the output image signal to the data voltages; and a bias current control signal generator configured to receive the image pattern information and generate a bias current control signal for controlling a magnitude of a bias current of the data driver for the frame based on the image pattern information, wherein;

the bias current control signal generator comprises a plurality of switches each corresponding to a different parameter from each other among a plurality of parameters; and one of the switches is turned on according to the image pattern information to select a parameter of the plurality of parameters, which is output as the bias current control signal.

2. The display device of claim 1, wherein the data driver comprises a bias unit for generating a bias current based on the bias current control signal.

3. The display device of claim 2, wherein the data driver comprises an amplifier configured to receive a voltage according to the bias current.

4. The display device of claim 3, wherein a minimum value of the parameters represents the image pattern of a gray-based image pattern.

5. The display device of claim 4, wherein a maximum value of the parameters represents the image pattern of a vertical stripe pattern in a row unit.

6. The display device of claim 5, wherein pixels of one pixel column of the pixels are alternatively connected to two adjacent data lines.

7. The display device of claim 6, wherein, during one frame:

a polarity of the data voltages applied to the data lines is constant; and polarities of the data voltages applied to adjacent data lines are opposite to each other.

8. The display device of claim 2, further comprising a signal controller configured to control the data driver, wherein the signal controller comprises the image pattern determiner and the bias current control signal generator.

9. The display device of claim 2, further comprising a signal controller configured to control the data driver, wherein the signal controller comprises the image pattern determiner, and the data driver comprises the bias current control signal generator.

10. A display device comprising:

a display panel comprising pixels and data lines;

an image pattern determiner configured to receive an input image signal of a frame, determine a type of an image pattern to be displayed on the display panel for the entire pixels based on the input image signal and generate an image pattern information about the type of the image pattern for the frame, the type of the image pattern being dependent on a degree of a dynamic power consumption;

a data driver configured to receive an output image signal and generate data voltages to be supplied to the data lines, the data driver comprising a digital to analog converter for converting the output image signal to the data voltages; and a bias current control signal generator configured to receive the image pattern information and generate a bias current control signal for controlling a magnitude of a bias current of the data driver for the frame based on the image pattern information, wherein:

the bias current control signal generator comprises a plurality of switches each corresponding to a different parameter from each other among a plurality of parameters; and one of the switches is turned on according to the image pattern information to select a parameter of the plurality of parameters, which is output as the bias current control signal;

the data driver comprises driving blocks, the driving blocks comprising a bias unit configured to receive the image pattern information and generate a bias current having a magnitude that is controlled according to image pattern information; and at least one of the driving blocks, except for the bias unit, is stopped during a first period of one frame while the bias unit does not stop during the first period.

11. The display device of claim 10, wherein the first period includes a vertical blank period.

12. A method of driving a display device comprising a display panel comprising a plurality of rows of pixels and data lines, an image pattern determiner, a bias current control signal generator, and a data driver, the method comprising:

determining a type of an image pattern to be displayed on the display panel for the entire plurality of rows of pixels based on an input image signal of a frame and generating an image pattern information about the type of the image pattern for the frame, by the image pattern determiner, the type of the image pattern being dependent on a degree of a dynamic power consumption;

turning on, according to the image pattern information, at least one of a plurality of switches each corresponding to a different parameter from each other among a plurality of parameters of the bias current control signal generator, to select a parameter of the plurality of parameters, which is output as a bias current control signal for controlling a magnitude of a bias current of the data driver, by the bias current control signal generator;

generating a bias current for the frame based on the bias current control signal, by the data driver;

generating data voltages based on the input image signal, by the data driver;

and applying the data voltages to the data lines.

13. The driving method of claim 12, wherein a minimum value of the parameters represents the image pattern of a gray-based image pattern.

14. The driving method of claim 13, wherein a maximum value of the parameters represents the image pattern of a vertical stripe pattern in a row unit.

15. The driving method of claim 14, wherein:

a polarity of the data voltage applied to one data line during one frame is constant; and polarities of the data voltages applied to adjacent data lines are opposite to each other.

16. A method of driving a display device comprising a display panel comprising pixels and data lines, an image pattern determiner, and a data driver comprising driving blocks, the driving blocks comprising a bias unit, the method comprising:

determining a type of an image pattern to be displayed on the display panel for the entire pixels based on an input image signal of a frame and generating an image pattern information about the type of the image pattern for the frame, by the image pattern determiner, the type of the image pattern being dependent on a degree of a dynamic power consumption; generating data voltages based on the input image signal, by the data driver; and a bias current control signal generator configured to receive the image pattern information and generate a bias current control signal for controlling a magnitude of a bias current of the data driver for the frame based on the image pattern information, wherein;

the bias current control signal generator comprises a plurality of switches each corresponding to a different parameter from each other among a plurality of parameters; and one of the switches is turned on according to the image pattern information to select a parameter of the plurality of parameters, which is output as the bias current control signal;

receiving the image pattern information and generating a bias current having a magnitude that is controlled according to the image pattern information; and stopping at least one of the driving blocks, except for the bias unit, during a first period of one frame while the bias unit does not stop during the first period.

17. The driving method of claim 16, wherein the first period comprises a vertical blank period.

* * * * *